US008150077B2

(12) United States Patent
Akino et al.

(10) Patent No.: US 8,150,077 B2
(45) Date of Patent: Apr. 3, 2012

(54) MICROPHONE

(75) Inventors: Hiroshi Akino, Machida (JP); Mitsuo Nemoto, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 1338 days.

(21) Appl. No.: 11/752,031

(22) Filed: May 22, 2007

(65) Prior Publication Data

US 2007/0269059 A1 Nov. 22, 2007

(30) Foreign Application Priority Data

May 22, 2006 (JP) ..... 2006-141066

(51) Int. Cl.
*H04R 25/00* (2006.01)

(52) U.S. Cl. ..... 381/170; 381/182

(58) Field of Classification Search ..... 381/355, 381/356, 358, 357, 182, 375, 170
See application file for complete search history.

(56) References Cited

U.S. PATENT DOCUMENTS

| | | | | |
|---|---|---|---|---|
| 2002/0080983 | A1* | 6/2002 | Paritsky et al. | 381/172 |
| 2005/0152571 | A1* | 7/2005 | Chang | 381/355 |
| 2006/0262946 | A1* | 11/2006 | Yang | 381/175 |

FOREIGN PATENT DOCUMENTS

| | | |
|---|---|---|
| JP | 57-53200 | 3/1982 |
| JP | 60-172497 | 11/1985 |
| JP | 8-214391 | 8/1996 |
| JP | 10-75497 | 3/1998 |

OTHER PUBLICATIONS

Japanese Office Action issued on Feb. 15, 2011 in the corresponding Japanese Patent Application No. 2006-141066 (with English Translation).

* cited by examiner

*Primary Examiner* — Davetta W Goins
*Assistant Examiner* — Amir Etesam
(74) *Attorney, Agent, or Firm* — Oblon, Spivak, McClelland, Maier & Neustadt, L.L.P.

(57) ABSTRACT

To obtain a composite type microphone, the microphone preventing an increase in size and weight and thereby improving the freedom for installation and handling while keeping the phases of signals output from respective microphone units the same. A composite type microphone that incorporates microphone units of different electroacoustic conversion methods into a common microphone body is provided. Here, in a front acoustic terminal portion of a first microphone unit based on one electroacoustic conversion method, a second microphone unit based on another electroacoustic conversion method is disposed, and in the front acoustic terminal portion of the first microphone unit, an air that vibrates in the same phase with that of a vibrating plate of the first microphone unit exists, and within the air that vibrates in the same phase with that of the vibrating plate of the first microphone unit, the second microphone unit is disposed.

8 Claims, 1 Drawing Sheet

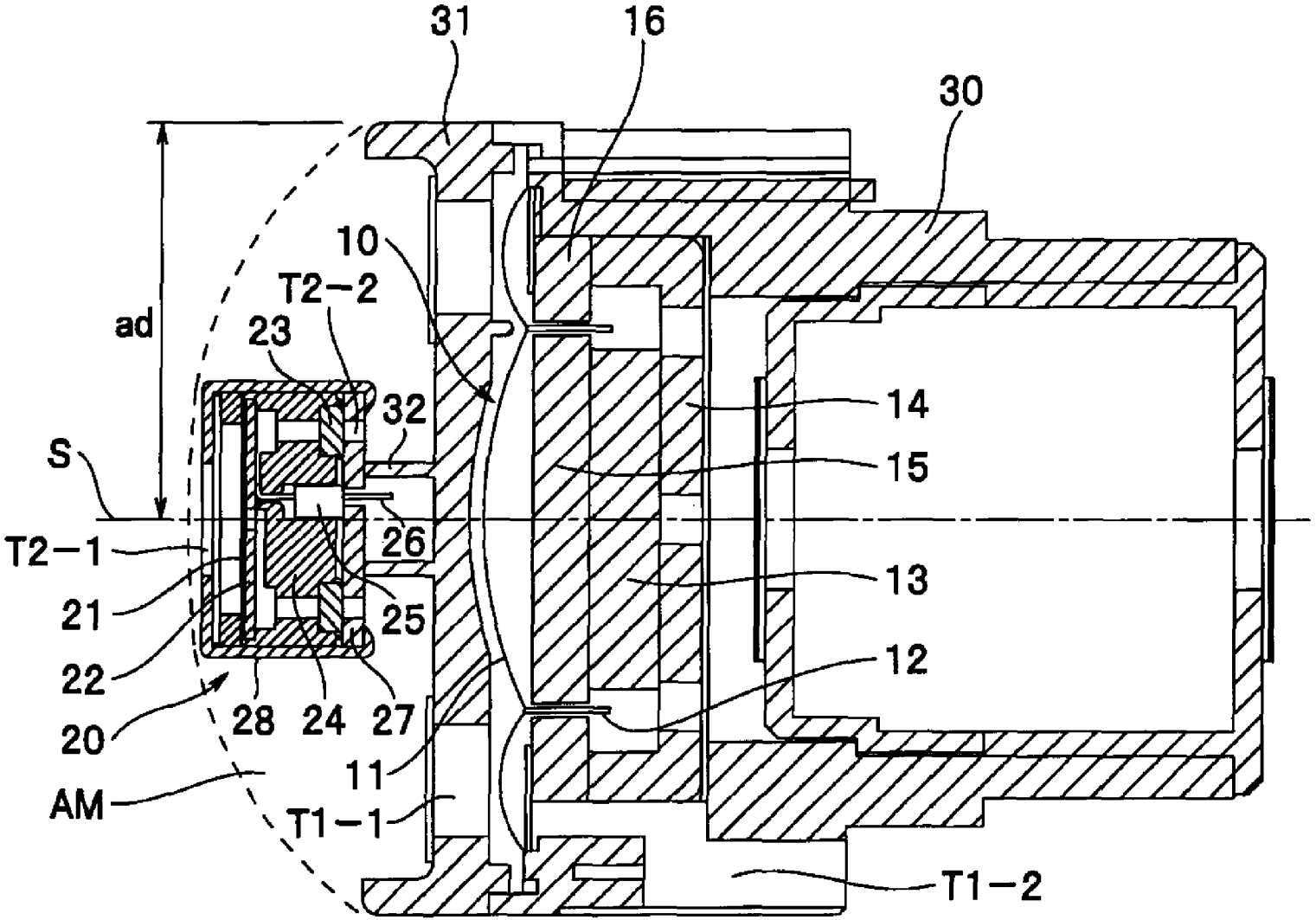
30
16
31
10
T2-2
23
32
26
25
27
24
28
11
T1-1
T1-2
14
15
13
12
ad
S
T2-1
21
22
20
AM

MICROPHONE

BACKGROUND OF THE INVENTION

1. Field of the Invention

The present invention relates to a composite type microphone that incorporates a plurality of microphone units of different electroacoustic conversion methods into a common microphone body, e.g., the composite type microphone capable of disposing a condenser microphone unit in a front acoustic terminal portion of a dynamic microphone unit.

2. Related Background of the Invention

In recording a sound generated from the same musical instrument or the like, microphones of different electroacoustic conversion methods, e.g., a dynamic microphone and a condenser microphone, are sometimes disposed side by side for use. This is intended to record a sound from the same sound source with a plurality of microphones of different conversion methods and mix the output signals of the respective microphones, thereby taking advantage of the characteristics of the respective microphones, because the microphones of different electroacoustic conversion methods have mutually different sound quality. In particular, such recording form is often employed in recording a bass drum.

In case of attempting to record a sound coming from the same sound source with a plurality of microphones of different conversion methods as described above, since a phase difference occurs in the output signals of both microphones depending on the relative installation position relation between both microphones, the relative installation position of the plurality of microphones is carefully determined so as not to cause a phase difference. When a player plays a musical instrument, however, there is a drawback that a stand supporting the microphone vibrates, the installation position of microphone will shift with this vibration and the initial installation position can not be maintained, resulting in a phase difference in the output signals of the mutual microphones.

In order to solve such positional shift problem, composite type microphones are put in practical use. The conventional composite type microphone is made by disposing microphone units of mutually different electroacoustic conversion methods, e.g., a dynamic microphone unit and a condenser microphone unit, in parallel within a single microphone body to position vibrating plates of both microphone units on the same plane. According to such conventional composite type microphone, even if the installation position of the microphone has shifted due to playing of a musical instrument and the like, the mutual positional relation between two microphone units incorporated in the microphone body will not shift and thus the mutual phase of the output signals from two microphone units will not shift.

However, since the conventional composite type microphone is made by disposing two microphone units in parallel to integrate, a drawback is that the microphone is increased in size in the diameter direction. Since the upsized microphone is difficult to install and increases its weight, a drawback is that the microphone stand also needs to have a robust structure, thus increasing its weight and causing a difficulty in handling.

In addition, as a known art related to the composite type microphone, there is a microphone made by combining a bone-conduction microphone and an air-conduction microphone, which is used under noise environment. Such type of composite type microphone includes a combining control circuit for combining the output component of bone conduction from the bone-conduction microphone and the output component of air conduction from the air-conduction microphone. A combining control circuit is proposed, which includes a noise-level measurement unit for measuring the external noise level, and is configured to carry out a control of increasing a ratio of the output component of air conduction to the output component of bone conduction when the external noise level measured by this measurement unit is small, and decreasing the ratio of the output component of air conduction to the output component of bone conduction when the external noise level is high, so that the mixing ratio of the output component of bone conduction and the output component of air conduction is maintained appropriately even under fluctuation of the external noise (e.g., see Japanese Patent Application Laid-Open No. 8-214391).

The invention described in Japanese Patent Application Laid-Open No. 8-214391 however differs from the present invention in the problem to be solved and in the means for solving the problem.

As a known art related to the composite type microphone, there is also a composite type microphone made by integrating an FM wireless microphone circuitry and an optical wireless microphone circuitry. This is a wireless microphone device which accommodates the FM wireless microphone circuitry and the optical wireless microphone circuitry in the same housing, wherein an optical system of a high sound quality and a radio wave system capable of providing a long propagation distance are shared by means of a combination of a multiplication circuitry, a frequency conversion circuitry, and a PLL circuitry (e.g., see Japanese Patent Application Laid-Open No. 10-75497).

The invention described in Japanese Patent Application Laid-Open No. 10-75497 however differs from the present invention in the problems to be solved and in the means for solving the problems.

SUMMARY OF THE INVENTION

Problem to be Solved by the Invention

The present invention is intended to provide a composite type microphone that incorporates microphone units of different electroacoustic conversion methods into a common microphone body, and is capable of preventing an increase in size and weight while keeping the phases of signals output from the respective microphones the same and is capable of improving the freedom for installation and handling.

Means for Solving the Problem

A main feature of the present invention is a composite type microphone that incorporates microphone units of different electroacoustic conversion methods into a common microphone body, wherein in a front acoustic terminal portion of a first microphone unit based on one electroacoustic conversion method, a second microphone unit based on another electroacoustic conversion method is disposed.

The second microphone unit is preferably disposed such that the center thereof is aligned with the acoustic center of a front acoustic terminal of the first microphone unit.

Since in the front acoustic terminal portion of first microphone unit, an air that vibrates in the same phase with that of a vibrating plate of the first microphone unit exists, the second microphone unit is more preferably disposed within the air that vibrates in the same phase with that of the vibrating plate of the first microphone unit.

Preferably the first microphone unit is a dynamic microphone unit and the second microphone unit is a condenser microphone unit.

Advantages of the Invention

In a front acoustic terminal portion of a first microphone unit based on one electroacoustic conversion method, a second microphone unit based on another electroacoustic conversion method is disposed, and therefore the first and second microphone units are disposed in series in the front-back direction and it is thus possible to prevent a microphone from increasing in size in the diameter direction and to improve freedom for installation and handling.

If the second microphone unit is disposed within the air that vibrates in the same phase with that of the vibrating plate of the first microphone unit in the front acoustic terminal portion of the first microphone unit, it is possible to vibrate the vibrating plates of the first and second microphone units in the same phase and to eliminate a phase shift of the signals output from the first and second microphone units.

BRIEF DESCRIPTION OF THE DRAWINGS

FIG. 1 is a vertical cross-sectional view showing an embodiment of a microphone concerning the present invention.

DESCRIPTION OF THE PREFERRED EMBODIMENTS

An embodiment of a microphone concerning the present invention will be described hereinafter with reference to the accompanying drawing.

In FIG. 1, in a front end portion (at the left end portion in FIG. 1) of a case 30 serving as a microphone body that is formed in a cylindrical shape, a dynamic microphone unit 10 is incorporated as a first microphone unit. Also to the microphone body case 30, a condenser microphone unit 20 projecting forwardly from the front end of the microphone body case 30 is attached as a second microphone unit. Accordingly, two microphone units of different electroacoustic conversion methods are incorporated in the common microphone body case 30 to constitute a composite type microphone.

The dynamic microphone unit 10 includes a diaphragm 11 as a vibrating plate disposed at the front end portion of the microphone body case 30, a coil 12 projectingly secured to the back face side of the diaphragm 11, a permanent magnet 13, a back yoke 14, a front yoke 15, and a front side outer peripheral yoke 16. The diaphragm 11 has a relatively large dome-shaped portion as its main body, wherein the periphery thereof forms a dome-shaped edge with a small cross section and the peripheral portion of the edge is secured to the front end of the microphone body case 30. To a boundary between the dome-shaped portion in the center and the dome-shaped edge, one end of the coil 12 wound up in a cylindrical shape is secured. When the diaphragm 11 receives a sound wave, it vibrates with the above-described secured portion being as a supporting point and the coil 12 also vibrates in the front-back direction integrally with the diaphragm 11.

The permanent magnet 13, the back yoke 14, the front yoke 15, and the front side outer peripheral yoke 16 are members constituting a magnetic circuit, and the back yoke 14 and the front yoke 15 are stacked across the permanent magnet 13. The back yoke 14 is formed in the shape of closed-end cylinder by its outer peripheral portion being cylindrically formed, and the front end face of the cylindrical outer peripheral portion and the back end face of the front side outer peripheral yoke 16 are secured to each other. The front yoke 15 and the front side outer peripheral yoke 16 are positioned at the inner peripheral side and at the outer peripheral side, respectively, in the same plane, and a cylindrical gap is formed between the outer peripheral face of the front yoke 15 and the inner peripheral face of the front side outer peripheral yoke 16, and the coil 12 passes through this gap. The permanent magnet 13, the back yoke 14, the front yoke 15, the front side outer peripheral yoke 16, and the above-described gap constitute a magnetic circuit, thus forming a magnetic field in the gap. The coil 12 exists within this magnetic field. When receiving a sound wave, the diaphragm 11 vibrates and the coil 12 moves with the diaphragm 11 and crosses the magnetic field, thereby generating an electric signal in the coil 12 and this electric signal is output as a sound signal. In this way, the microphone unit is constituted by the diaphragm 11, the coil 12, the permanent magnet 13 forming the magnetic circuit, and the like.

To the front end of the microphone body case 30, an end plate 31 is fixed covering the diaphragm 11 and forming an appropriate gap between the same and the diaphragm 11. In the end plate 31, there are formed an appropriate number of holes for connecting the front side of the interior space, in which the diaphragm 11 exists, with the exterior space, and these holes constitute a front side acoustic terminal T1-1 of the dynamic microphone unit 10. Near the outer periphery of the microphone body case 30, there are formed an appropriate number of holes for connecting the back side of the interior space, in which the diaphragm 11 exists, with the exterior space, and these holes constitute a back side acoustic terminal T1-2 of the dynamic microphone unit 10.

The condenser microphone unit 20 is fixed to a support medium 32 that integrally extends from the front end face of the end plate 31. The condenser microphone unit 20 includes, in a cylindrical unit case 28, a diaphragm 21 as a vibrating plate, a back plate 22 that is fixed with an appropriate gap being formed behind the diaphragm 21, an insulator 24 disposed behind the back plate 22, and an end plate 27 disposed behind the insulator 24. Since the output impedance of the condenser microphone unit 20 is extremely high, an impedance conversion circuit including an FET (field effect transistor) 25 as a basic component is incorporated therein. The FET 25 is disposed so as to be buried in the insulator 24, and an output terminal of the FET 25 is passed through a hole of the end plate 27 and is brought out backward as an output terminal 26 of the condenser microphone unit 20.

In the center of the front end face of the unit case 28, a hole for releasing the front face of the diaphragm 21 to the exterior space is formed and this hole serves as a front side acoustic terminal T2-1 of the condenser microphone unit 20. In the back plate 22, the insulator 24, and the end plate 27, there is formed a hole for connecting the back face of the diaphragm 21 with the exterior space and this hole serves as a back side acoustic terminal T2-2 of the condenser microphone unit 20. An acoustic resistor 23 is disposed in the middle of the back side acoustic terminal T2-2. The outer diameter of the condenser microphone unit 20 is small relative to the outer diameter of the dynamic microphone unit 10 and is on the order of approximately ½.

In the description of the prior art, a phase difference in the output signals at the time of using a plurality of microphones with respect to one sound source was described. Further, it was also described that the phase difference problem does not occur if the diaphragms of the respective units exist on the same plane in the composite type microphone in which a plurality of microphone units are incorporated in a common microphone body.

However, according to the illustrated embodiment, the diaphragms 11 and 21 of the first and second microphone units are positioned as shifted back and forth, and thus this embodiment seems to have factors that cause a phase difference in the output signals of the respective microphone units. Under a certain condition, however, even if the diaphragms 11 and 21 of the first and second microphone units are positioned as shifted back and forth, it is possible to align the phases of the output signals of the respective microphone units to each other, and the illustrated embodiment satisfies this condition. This condition will be described hereinafter.

In the microphone, an air that vibrates in the same phase with that of the diaphragm exists near the acoustic terminal. The acoustic center of the front acoustic terminal exists in the portion of the air that vibrates in the same phase with that of the diaphragm. Now, assuming that the outer diameter of the dynamic microphone unit 10, which is the first microphone unit, is approximately 28 mm, then the radius ad is 1.4 (cm). Let ρ denote the density of air, then $\rho=1.22\times10^{-3}$ (g/cm$^3$), and the mass M of the air that moves with the diaphragm 11 due to the vibration of the diaphragm 11 is given as follows.

$$\begin{aligned} M &= 0.61\Pi\rho ad^3\,(\mathrm{g}) \\ &= 0.61\times3.14\times1.22\times10^{-3}\times1.4^3 \\ &= 6.41\,(\mathrm{mg}) \end{aligned}$$

In other words, there exists an air corresponding to the mass (additional mass) 6.41 (mg) that vibrates in the same phase with that of the diaphragm 11 due to the vibration of the diaphragm 11. For this reason, the acoustic center of the front acoustic terminal of the microphone exists forward of the microphone unit 10 itself. Moreover, the larger the diameter of the microphone unit, the further forward of the acoustic center is positioned. In FIG. 1, a broken line depicted in a dome shape in front of the dynamic microphone 10 indicates a borderline of the air that vibrates in the same phase with that of the diaphragm 11. In a space AM inside this borderline, the air that vibrates in the same phase with that of the diaphragm 11 exists. Accordingly, if the second microphone unit is disposed in the space AM, it is possible to vibrate the diaphragms of the first and second microphone units in the same phase with respect to the same sound source and thereby obtain the output signals of the same phase.

The condenser microphone unit can be produced with a small diameter and size as compared with the dynamic microphone unit. Then, in the illustrated embodiment, the dynamic microphone unit 10 with a relatively large diameter is the first microphone unit, and the condenser microphone unit 20 as the second microphone unit is disposed with its center being aligned with an acoustic center S of the front acoustic terminal. In this way, the condenser microphone unit 20, which is the second microphone unit, is disposed in the space AM, in which the air exists that vibrates in the same phase with that of the vibrating plate 11 of the dynamic microphone unit 10 of the front acoustic terminal portion of the dynamic microphone unit 10, which is the first microphone unit, and therefore the phases of the output signals of the dynamic microphone unit 10 and the condenser microphone unit 20 with respect to the same sound source can be aligned although the dynamic microphone unit 10 and the condenser microphone unit 20 are disposed in series as shifted in the front-back direction.

Also, according to the above-described embodiment, since the first and second microphone units are disposed in the front-back direction of the common microphone body and with the respective axis lines being the same, the diameter of the composite type microphone can be reduced. By setting the second microphone unit as a condenser microphone unit capable of being miniaturized, it is possible to set the length in the front-back direction of the composite type microphone to almost the same length as that of a single dynamic microphone. In this way, miniaturization of the composite type microphone is possible, and thus the weight of the composite type microphone also can be reduced, allowing an easily handled composite type microphone to be provided.

The electroacoustic conversion methods of the first microphone unit and the second microphone unit just need to differ from each other. Although the electroacoustic conversion method of each unit is not limited in particular, the second microphone unit is preferably as compact as possible as shown in the illustrated embodiment, and thus a condenser microphone unit is suitable.

What is claimed is:

1. A composite type microphone that incorporates microphone units of different electroacoustic conversion methods into a common microphone body, wherein in a front acoustic terminal portion of a first microphone unit based on one electroacoustic conversion method, a second microphone unit based on another electroacoustic conversion method is disposed;

in the front acoustic terminal portion of the first microphone unit, an air that vibrates in the same phase with that of a vibrating plate of the first microphone unit exists;

within the air that vibrates in the same phase with that of the vibrating plate of the first microphone unit, the second microphone unit is disposed;

the second microphone unit is disposed such that the center thereof is aligned with an acoustic center of a front acoustic terminal of the first microphone unit; and the first and second microphone units output signals of a same phase.

2. The microphone according to claim 1, wherein a diameter of the second microphone unit is smaller than a diameter of the first microphone unit.

3. The microphone according to claim 1, wherein the first microphone unit is a dynamic microphone unit and the second microphone unit is a condenser microphone unit.

4. A composite type microphone, comprising:

a first microphone unit, including a first transducer type, and a first vibrating plate configured to generate a space in which air vibrates in the same phase with that of the first vibrating plate; and a second microphone unit, including a second transducer type that is different form the first transducer type, and a second vibrating plate disposed within the space in which the air vibrates in the same phase with that of the first vibrating plate included in the first microphone unit, wherein the center of the second microphone unit is aligned with an acoustic center of a front acoustic terminal of the first microphone unit; and the first and second microphone units output signals of a same phase.

5. The microphone according to claim 4, wherein a diameter of the second microphone unit is smaller than a diameter of the first microphone unit.

6. The microphone according to claim 4, wherein the first microphone unit is a dynamic microphone unit and the second microphone unit is a condenser microphone unit.

7. The microphone according to claim 4, wherein the second microphone unit is disposed in front of the first microphone unit.

8. A composite type microphone, comprising:

a first microphone unit, including means for performing a first electroacoustic conversion method, and means for generating a space in which air vibrates in the same phase with that of the means for generating the space; and a second microphone unit, including means for performing a second electroacoustic conversion method that is different from the first electroacoustic conversion method, and means for receiving a sound wave disposed within the space in which the air vibrates in the same phase with that of the means for generating the space, wherein the center of the second microphone unit is aligned with an acoustic center of a front acoustic terminal of the first microphone unit; and the first and second microphone units output signals of the same phase.

* * * * *